United States Patent [19]

Martin et al.

[11] 4,108,151

[45] Aug. 22, 1978

[54] GAMMA ALUMINA FILLED PAPER WRAPPER FOR SMOKING ARTICLES

[75] Inventors: R. Hugo Martin; William F. Owens, Jr., both of Pisgah Forest, N.C.

[73] Assignee: Olin Corporation, Pisgah Forest, N.C.

[21] Appl. No.: 776,183

[22] Filed: Mar. 10, 1977

Related U.S. Application Data

[63] Continuation of Ser. No. 639,293, Dec. 10, 1975, abandoned.

[51] Int. Cl.[2] ..... A24D 1/02

[52] U.S. Cl. ..... 131/9; 131/15 R; 162/139

[58] Field of Search ..... 131/4 A, 8 R, 8 A, 9, 131/10 R, 15, 266 R; 162/139

[56] References Cited

U.S. PATENT DOCUMENTS

| | | | |
|---|---|---|---|
| 3,106,210 | 10/1963 | Reynolds et al. | 131/15 R |
| 3,313,306 | 4/1967 | Berger et al. | 131/266 X |
| 3,744,496 | 7/1973 | McCarty et al. | 131/8 |

*Primary Examiner*—Robert W. Michell
*Assistant Examiner*—V. Millin
*Attorney, Agent, or Firm*—Robert W. Habel

[57] ABSTRACT

Cigarette paper containing a filler of gamma alumina, for selectively reducing the organic vapor phase constituents in tobacco smoke. The paper is comprised of cellulosic fibers and a gamma alumina filler with the amount of alumina filler present being at least 50% by weight based on the weight of the paper. Preferably, the amount of gamma alumina filler will range from 50 to 80%. In addition to reducing organic vapor phase constituents, the paper has unique advantages over conventional cigarette paper wrappers in that the visible sidestream smoke eminating from the smoking article is reduced.

4 Claims, No Drawings

GAMMA ALUMINA FILLED PAPER WRAPPER FOR SMOKING ARTICLES

BACKGROUND OF THE INVENTION

This application is a continuation of application Ser. No. 639,293 filed Dec. 10, 1975 now abandoned.

This invention relates generally to the manufacture of cigarette paper and wrappers for smoking articles and more particularly to a novel gamma alumina filled paper wrapper for smoking articles such as cigarettes, cigars and the like having unique advantages over conventional wrappers.

Cigarette paper customarily contains a filler of calcium carbonate modified with various burning chemicals to improve the burning rate and ash characteristics of the smoking article. Typical conventional papers are disclosed in U.S. Pat. Nos. 2,503,267; 2,580,608; and 2,580,611. While all of such papers are excellent wrappers for cigarettes, they have little, if any, effect upon reducing undesirable constituents in the smoke.

Carbon filled wrappers for smoking articles are disclosed in U.S. Pat. No. 3,744,496 and are quite efficient in removing vapor phase components and particulate matter from both the main and sidestream smoke. However, such wrappers tend to be very porous due to the carbon filler and because of their dark color are customarily used as an inner wrap under a conventional outer wrap of cigarette paper or cigar wrap in order to produce a satisfactory smoking article.

U.S. Pat. No. 2,755,207 discloses the use of a siliceous catalyst in cigarette paper to reduce acrid components in the smoke therefrom during burning. According to the patent, it is essential that such catalysts contain a minor amount of a difficultly reducible metal oxide such as alumina, zirconia, titania, chromium oxide, or magnesium oxide to be effective. The metal oxide gives the silica catalyst a certain acidic nature which is necessary for catalytic efficiency. However, such catalysts are complex, expensive, and impractical for conventional cigarette paper usage.

SUMMARY OF THE INVENTION

It is an object of this invention to provide a means for reducing the gaseous ingredients in the smoke of cigarettes, cigars and the like. A specific object is to provide a means for selectively reducing the quantity of gaseous components in cigarette and cigar smoke. A more specific object is to provide an efficient and inexpensive wrapper for the tobacco column in a smoking article which accomplishes the foregoing objects.

In accordance with this invention, we have found that cigarette paper containing a gamma alumina filler is an ideal wrapper for the tobacco column of cigarettes, cigars and the like and will produce selective reductions in major organic vapor phase components in the smoke from such smoking articles. Moreover, reductions occur in both the mainstream and sidestream smoke.

The paper of this invention is made using a conventional cigarette paper making furnish of cellulose fibers such as pulped wood or flax fibers, to which is added the gamma alumina filler. The furnish of cellulose fibers and gamma alumina filler is then used to make a paper sheet on a conventional paper making machine. While flax fiber is preferred, the particular cellulose fiber is not critical and any of the cellulose fiber pulps used in making cigarette paper are satisfactory. In addition to wood or flax fibers, the furnish may be pulped tobacco stalks or stems to which is added the gamma alumina filler or the alumina may be added to the furnish used in making reconstituted tobacco sheets for cigar wrap.

In order to achieve the desired reductions in smoke components, the paper should contain at least 50% by weight gamma alumina, based on the weight of the paper. Preferably, amounts of gamma alumina are used in the range of from 50 to 80% based on the weight of the paper. Gamma alumina ($\gamma Al_2O_3$), sometimes referred to as activated alumina, appears to be the only form of alumina that is effective in achieving the desired results. The alumina should be finely pulverized sufficient to pass through a 300-mesh screen or smaller to enable sheet formation of sufficiently low porosity such that the paper can be used as a single wrap for the tobacco column.

Various conventional burning chemicals may also be incorporated in the paper to improve the burning characteristics of the wrapper and enhance the ash appearance. Efficient burning chemicals are the alkali metal hydroxides, bicarbonates, and carbonates or various citrate, phosphate, and nitrate salts. If the paper is to be used as cigar wrap, brown dyes can be added to simulate the appearance of natural tobacco leaf.

Selective reductions in the organic vapor phase yield in mainstream cigarette smoke have been achieved with cigarettes made using the gamma alumina filled wrappers of this invention. Similar reductions are obtained in the sidestream smoke if the porosity of the alumina filled paper is within the range normally found in conventional cigarette wrappers. The cause for such reductions is not entirely clear. However, in all tests we have run with alumina filled wrappers, it has been noted that the ash color was dark gray to black indicating interaction between the smoke (both mainstream and sidestream) and the alumina filler. Since activated alumina is a well known cracking catalyst, the black discoloration of the paper wrapper ash is probably due to carbonization on the alumina surface. In any event, major vapor phase constituent yields in the smoke are reduced offering unique advantages over conventional wrappers for smoking articles.

PREFERRED EMBODIMENTS

Typical results demonstrating the effects obtained in accordance with this invention are described in the following examples which are illustrative of the invention only and are not in limitation thereof.

EXAMPLE I

Sample cigarettes were prepared using a wrapper for the tobacco column of gamma alumina filled paper. All samples were 70 mm in length and approximately 8 mm in diameter. The alumina filled papers were made using conventional paper making techniques from flax fiber pulp with a gamma alumina filler sold commercially as Alcoa H-51 Activated Alumina. The particle size of the filler was such that it would pass thrugh a 325-mesh screen. Various percentages of alumina filler were employed for different samples, both alone and in combination with calcium carbonate filler. For control purposes, identical cigarette samples were prepared with conventional cigarette paper wrappers containing only $Ca_2CO_3$ filler. The porosities of the control versus the test sample wrappers varied over a fairly wide range. The following table sets forth the various yields obtained from the sample cigarettes when compared with the control cigarettes based upon approximately 55 mm of tobacco column consumed during smoking (15 mm butt length).

TABLE I

| ORGANIC VAPOR PHASE (mg/cig), CO AND $CO_2$ (%) YIELDS | | | | | |
|---|---|---|---|---|---|
| | Wrapper - % Filler (Absolute Greiner Porosity, sec/50 cc) | | | | |
| Smoke Constituent | Control 33% $Ca_2CO_3$ (11.0) | 70% $Al_2O_3$ (3.6) | 60% $Al_2O_3$ (1.1) | 55% $Al_2O_3$-25% $Ca_2CO_3$ (2.1) | 50% $Al_2O_3$ (.2) |
| Isoprene | .48 | .24 | .24 | .42 | .10 |
| Acetaldehyde | .93 | .58 | .57 | .90 | .19 |
| Acetone | .53 | .33 | .30 | .45 | .12 |
| Methanol | .09 | .00 | .02 | .03 | .02 |
| Methyl Furan | .104 | .072 | .068 | .078 | .041 |
| Methyl Ethyl Ketone | .142 | .088 | .076 | .111 | .036 |
| Furan | .054 | .055 | .045 | .053 | .015 |
| Propionaldehyde | .073 | .087 | .065 | .081 | .024 |
| Acrolein | .102 | .118 | .100 | .125 | .027 |
| Methyl Acetate | .1018 | .011 | .012 | .014 | .006 |
| Isobutyraldehyde | .039 | .027 | .025 | .034 | .010 |
| CO, % | 3.7 | 4.29 | 2.46 | 2.95 | .44 |
| $CO_2$, % | 8.64 | 6.71 | 5.77 | 7.21 | 1.52 |

EXAMPLE II

Sample cigarettes were prepared in the same manner as described in Example I using various percentages of $CaCO_3$ filler in the wrappers for the control cigarettes and various percentages of gamma alumina as the filler in the wrappers of the test cigarettes. The porosities of the control and test wrappers were maintained within fairly narrow limits. Comparative smoking analyses for organic vapor phase constituents were made on all cigarettes using standard analytical procedures. The results are set forth in the following table.

TABLE II

| ORGANIC VAPOR PHASE (mg/cig) YIELDS | | | | | | |
|---|---|---|---|---|---|---|
| | Wrapper - % Filler (Absolute Greiner Porosity, sec/50 cc) | | | | | |
| | Control | | | | | |
| Smoke Constituent | 20% $Ca_2CO_3$ (3.6) | 50% $Ca_2CO_3$ (4.5) | 80% $Ca_2CO_3$ (1.8) | 20% $\gamma Al_2O_3$ (2.2) | 50% $\gamma Al_2O_3$ (3.9) | 80% $\gamma Al_2O_3$ (.8) |
| Isoprene | .63 | .51 | .40 | .64 | .49 | .16 |
| Acetaldehyde | 1.14 | 1.05 | .84 | 1.21 | 1.11 | .38 |
| Acetone | .57 | .51 | .42 | .62 | .53 | .21 |
| Methanol | .05 | .07 | .07 | .04 | .00 | .00 |
| Methyl Furan | .089 | .096 | .088 | .113 | .109 | .052 |
| Methyl Ethyl Ketone | .131 | .121 | .098 | .132 | .125 | .063 |
| Furan | .061 | .056 | .042 | .070 | .083 | .046 |
| Propionaldehyde | .100 | .093 | .084 | .110 | .117 | .059 |
| Acrolein | .150 | .137 | .092 | .160 | .163 | .076 |
| Methyl Acetate | .022 | .019 | .016 | .024 | .019 | .009 |
| Isobutyraldehyde | .043 | .040 | .033 | .045 | .038 | .019 |

As shown in the above tables, some of the major organic vapor phase constituents are selectively reduced in those sample cigarettes having at least a 50% alumina filled wrapper as compared to control cigarettes with conventional $Ca_2CO_3$ filled wrappers although, as shown in Table II, the results are less dramatic when the porosities of the control and test wrappers are maintained within closer limits. Wrappers containing higher percentages of alumina produce greater reductions over an increased range of vapor phase constituents. Reductions were also obtained in visible sidestream smoke. Comparable results may also be obtained when the alumina filled papers are used as the wrapper for cigars.

The unique advantages of the alumina filled paper as a wrapper for smoking articles are quite apparent from the foregoing examples. Many variations will become apparent to those skilled in the art and the invention is not limited to the examples shown. Various modifications and changes may be made without departing from the spirit and scope of the invention as defined in the following claims.

What we claim is:

1. A combustible cigarette paper that is effective in selectively reducing the vapor phase constituents in tobacco smoke, comprising cellulose fibers and a gamma alumina filler, substantially free of other crystalline forms of alumina said cigarette paper containing from 50 to 80% of said gamma alumina filler based on the weight of the filled paper, said gamma alumina filler pulverized to pass through a 300-mesh screen.

2. A method for selectively reducing the vapor phase constituents in tobacco smoke from a smoking article comprising uniformly dispersing in the tobacco column wrapper for said smoking article at least 50% by weight of finely pulverized gamma alumina filler based upon the weight of the filled wrapper said gamma alumina filler substantially free of other crystalline forms of alumina.

3. A method for selectively reducing the vapor phase constituents in cigarette smoke comprising enclosing the tobacco column of the cigarette with cigarette paper made from cellulose fiber and a filler of finely pulverized gamma alumina, substantially free of other crystalline forms of alumina said paper containing from 50 to 80% by weight gamma alumina filler based on the weight of the filled paper.

4. The method of claim 3 in which the gamma alumina filler is pulverized to pass through a 300-mesh screen.

* * * * *